US010235932B2

(12) United States Patent
Wu et al.

(10) Patent No.: US 10,235,932 B2
(45) Date of Patent: Mar. 19, 2019

(54) OLED INVERTING CIRCUIT AND DISPLAY PANEL

(71) Applicants: Shanghai Tianma AM-OLED Co., Ltd., Shanghai (CN); Tianma Micro-Electronics Co., Ltd., Shenzhen (CN)

(72) Inventors: Tong Wu, Shanghai (CN); Dong Qian, Shanghai (CN)

(73) Assignees: Shanghai Tianma AM-OLED Co., Ltd., Shanghai (CN); Tianma Micro-Electronics Co., Ltd., Shenzhen (CN)

( * ) Notice: Subject to any disclaimer, the term of this patent is extended or adjusted under 35 U.S.C. 154(b) by 64 days.

(21) Appl. No.: 15/590,186

(22) Filed: May 9, 2017

(65) Prior Publication Data

US 2017/0243535 A1 Aug. 24, 2017

Related U.S. Application Data

(62) Division of application No. 14/526,505, filed on Oct. 28, 2014, now Pat. No. 9,679,514.

(30) Foreign Application Priority Data

Jun. 30, 2014 (CN) ..... 2014 1 0309278

(51) Int. Cl.
*G09G 3/32* (2016.01)
*G09G 3/36* (2006.01)
(Continued)

(52) U.S. Cl.
CPC ..... *G09G 3/3225* (2013.01); *G09G 3/3677* (2013.01); *H05B 33/0896* (2013.01);
(Continued)

(58) Field of Classification Search
CPC .. G09G 3/3674; G09G 3/3677; G09G 3/3266; G09G 2310/0286; G09G 2310/0289
See application file for complete search history.

(56) References Cited

U.S. PATENT DOCUMENTS 8,629,816 B2 1/2014 Chung
2005/0156844 A1* 7/2005 Kanbara ..... H03K 5/086 345/92

(Continued)

FOREIGN PATENT DOCUMENTS

CN 1236954 A 12/1999
CN 103268749 A 8/2013
KR 100796125 B1 1/2008

*Primary Examiner* — Xuemei Zheng
(74) *Attorney, Agent, or Firm* — Anova Law Group, PLLC

(57) ABSTRACT

An inverting circuit is disclosed. The inverting circuit includes a pull-up unit including first, second, and third terminals. The first terminal receives a first control signal, and the third terminal is connected to a signal output terminal and outputs a first level signal. The inverting circuit also includes a pull-down unit including fourth, fifth, and sixth terminals. The fourth terminal is connected to the second terminal of the pull-up unit, and the fifth terminal receives a second control signal. In addition, the sixth terminal is connected to the signal output terminal and outputs a second level signal. The inverting circuit also includes a first capacitor, connected to the second terminal of the pull-up unit and the fourth terminal of the pull-down unit, and to the third terminal of the pull-up unit and the sixth terminal of the pull-down unit.

8 Claims, 12 Drawing Sheets

(51) Int. Cl.
*G09G 3/3225* (2016.01)
*H05B 33/08* (2006.01)
*G09G 3/3266* (2016.01)

(52) U.S. Cl.
CPC ... *G09G 3/3266* (2013.01); *G09G 2310/0286* (2013.01); *G09G 2310/0289* (2013.01)

(56) References Cited

U.S. PATENT DOCUMENTS

| | | | | |
|---|---|---|---|---|
| 2007/0040450 | A1* | 2/2007 | Chung | G09G 3/3225 307/109 |
| 2011/0057864 | A1 | 3/2011 | Chung | |
| 2011/0157123 | A1 | 6/2011 | Cho | |
| 2011/0193855 | A1* | 8/2011 | Han | G09G 3/3233 345/214 |
| 2012/0013588 | A1 | 1/2012 | Chung | |
| 2012/0105423 | A1 | 5/2012 | Chung | |
| 2012/0327131 | A1 | 12/2012 | Jang | |
| 2014/0111403 | A1* | 4/2014 | Kim | G11C 19/28 345/76 |
| 2015/0248940 | A1* | 9/2015 | Yang | G09G 3/3677 377/64 |

* cited by examiner

OLED INVERTING CIRCUIT AND DISPLAY PANEL

CROSS-REFERENCES TO RELATED APPLICATIONS

The present application is a divisional application of U.S. patent application Ser. No. 14/526,505, filed on Oct. 28, 2014, which claims priority to Chinese Patent Application No. 201410309278.7, filed with the State Intellectual Property Office of People's Republic of China on Jun. 30, 2014 entitled "OLED INVERTING CIRCUIT AND DISPLAY PANEL", the content of all of which is incorporated herein by reference in its entirety.

TECHNICAL FIELD

The present disclosure relates to the technical field of Organic Light Emitting Display (OLED) display, and in particular to an OLED inverting circuit and a display panel.

BACKGROUND

Recently, in the field of display device, a current-driven optical device has been developed, the light intensity of which varies with a value of the current flowing there through. For example, there is a display device in which an Organic Light Emitting Device (OLED) is adopted as a light emitting device for a pixel. Different from a liquid crystal device, the OLED is a self-luminescence device. In a display device in which the OLED is adopted, classification of a color is obtained by controlling the current in the OLED.

As with a liquid crystal display, a driving system in the OLED may be a passive matrix system or an active matrix system. The passive matrix system has a simple structure; however, it is difficult to achieve a display device with large size and high resolution by adopting the passive matrix system. Therefore, the development of the active matrix system is popular. In the active matrix system, a transistor is driven to control the current in the light emitting device provided for each pixel.

Presently, in designing an Active Matrix Organic Light Emitting Diode (AMOLED), especially a large-size substrate, unevenness of the current in the OLED is caused due to the unevenness and instability of a Thin Film Transistor (TFT) during its manufacturing process. To offset the threshold voltage shift (Vth Shift) due to the unevenness of the TFT during the manufacturing process of a backplane, and the instability of the TFT due to turning on a bias voltage for a long time, it is necessary to design a compensation circuit. In the conventional art, a P-type Metal Oxide Semiconductor (Pure PMOS) driving circuit is used, and the driving circuit outputs an effective low level; but during node initialization, threshold detection and data inputting, the OLED device needs to be turned off. Due to the single PMOS, the Pure PMOS is turned on in the case of a low voltage of the gate electrode, and turned off in the case of a high voltage of the gate electrode. The Pure PMOS driving circuit generally outputs effective low level. Therefore the signal output from the Pure PMOS driving circuit needs to be inverted, so that the OLED device is turned off. The inverting of the signal is achieved by a light emitting-control led (EMIT) driving circuit in the conventional art.

To achieve the inversion into a high level from a low level, an inverter is proposed in the conventional art, the structural diagram of which is shown in FIG. 1*a*. The inverter includes N-type TFT and a P-type TFT. A gate electrode of the P-type TFT is connected to a gate electrode of the N-type TFT, and is connected to an input terminal IN together with the gate electrode of the N-type TFT. A source electrode of the P-type TFT is connected to a high-voltage signal (VGH). A drain electrode of the N-type TFT is connected to a low-voltage signal (VGL). A drain electrode of the P-type TFT is connected to a source electrode of the N-type TFT, and is connected to an output terminal (OUT) together with the source electrode of the N-type TFT. FIG. 1*b* is a control timing diagram of the CMOS inverting circuit in FIG. 1*a*. It can be seen from FIG. 1*b* that when the IN is in high level, the P-type TFT is turned off, the N-type TFT is turned on, and the OUT outputs a low level signal; and when the IN is in a low level, the P-type TFT is turned on, the N-type TFT is turned off, and the OUT outputs a high-level signal. Since such PMOS inverter has both the P-type TFT and the N-type TFT, the manufacturing process is complicated, and the cost is high as compared with the pure P-type inverter or the pure N-type inverter.

To achieve the inversion into a high level from a low level, another inverter is proposed in the conventional art, the structural diagram of which is shown in FIG. 2*a*. The inverter includes two P-type TFTs, i.e., a first TFT and a second TFT. A gate electrode of the first TFT is connected to an input terminal IN, a source electrode of the first TFT is connected to a high-voltage signal (VGH), and a drain electrode of the first TFT is connected to an output terminal (OUT). A gate electrode and a drain electrode of the second TFT each are connected to a low-voltage signal (VGL), and a source electrode of the second TFT is connected to the OUT. FIG. 2*b* is a control timing diagram of the pure PMOS inverting circuit in FIG. 2*a*. It can be seen from FIG. 2*b* that when the IN inputs high level, the first TFT is turned off, the OUT outputs low level due to the Diode connection manner of the second TFT (in which the gate electrode and the drain electrode of the second TFT each are connected to the low-voltage signal VGL), and the voltage of the low level is higher than the VGL by Vth. When the IN is in low level, the first TFT and the second TFT each are turned on, the OUT outputs high level. However, in the above circuit, the OUT is connected to both the VGH and the VGL, and if the TFT is turned on/off completely, the OUT is connected to either VGH or VGL, and the OUT takes the VGH as the high voltage and the VGL as the low voltage. The above circuit has the problem that the two TFTs are turned on at the same time, and with this, the OUT outputs the intermediate level between the VGH and the VGL due to the voltage-division function. That is to say, the high/low output level is between the VGH and the VGL, which is not enough, then the power supply continuously supplies power, the power consumption is increased. Further, since the output level is not enough (input ranges from −5V to 10V, and output ranges from −4.43V to 5.07V), the TFT in the pixel cannot be controlled effectively, so that the compensation circuit cannot work effectively.

SUMMARY

One inventive aspect is an inverting circuit applicable to an active matrix organic light emitting display panel. The inverting circuit includes a pull-up unit including a first power supply input terminal, where the first power supply input terminal is configured to receive a first voltage signal. The pull-up unit also includes first, second, and third terminals. The first terminal is configured to receive a first control signal, and the third terminal is electrically connected to a signal output terminal and is configured to output a first level signal. The inverting circuit also includes a pull-down unit including a second power supply input terminal, and fourth, fifth, and sixth terminals. The fourth terminal is electrically connected to the second terminal of the pull-up unit, the second power supply input terminal is configured to receive a second voltage signal, and the fifth terminal is configured to receive a second control signal. In addition, the sixth terminal is electrically connected to the signal output terminal and is configured to output a second level signal. The inverting circuit also includes a first capacitor, where a first terminal of the first capacitor is electrically connected to the second terminal of the pull-up unit and the fourth terminal of the pull-down unit, and a second terminal of the capacitor is electrically connected to the third terminal of the pull-up unit and the sixth terminal of the pull-down unit.

Another inventive aspect is a display panel, including an inverting circuit. The inverting circuit includes a pull-up unit including, a first power supply input terminal, where the first power supply input terminal is configured to receive a first voltage signal. The pull-up unit also includes first, second, and third terminals. The first terminal is configured to receive a first control signal, and the third terminal is electrically connected to a signal output terminal and is configured to output a first level signal. The inverting circuit also includes a pull-down unit including a second power supply input terminal, and fourth, fifth, and sixth terminals. The fourth terminal is electrically connected to the second terminal of the pull-up unit, the second power supply input terminal is configured to receive a second voltage signal, and the fifth terminal is configured to receive a second control signal. In addition, the sixth terminal is electrically connected to the signal output terminal and is configured to output a second level signal. The inverting circuit also includes a first capacitor, where a first terminal of the first capacitor is electrically connected to the second terminal of the pull-up unit and the fourth terminal of the pull-down unit, and a second terminal of the capacitor is electrically connected to the third terminal of the pull-up unit and the sixth terminal of the pull-down unit.

Another inventive aspect is a driving method for an inverting circuit, where The inverting circuit includes a pull-up unit including a first power supply input terminal, where the first power supply input terminal is configured to receive a first voltage signal, the pull-up unit also includes first, second, and third terminals. The first terminal is configured to receive a first control signal, and the third terminal is electrically connected to a signal output terminal and is configured to output a first level signal. The inverting circuit also includes a pull-down unit including a second power supply input terminal, and fourth, fifth, and sixth terminals. The fourth terminal is electrically connected to the second terminal of the pull-up unit, the second power supply input terminal is configured to receive a second voltage signal, and the fifth terminal is configured to receive a second control signal. In addition, the sixth terminal is electrically connected to the signal output terminal and is configured to output a second level signal. The inverting circuit also includes a first capacitor, where a first terminal of the first capacitor is electrically connected to the second terminal of the pull-up unit and the fourth terminal of the pull-down unit, and a second terminal of the capacitor is electrically connected to the third terminal of the pull-up unit and the sixth terminal of the pull-down unit. The first transistor, the second transistor, the third transistor and the fourth transistor each are P-type transistors. The first terminal of the pull-up, unit is a level signal input terminal, the second terminal of the pull-up unit is a first electrode of the second transistor, the third terminal of the pull-up unit is a first electrode of the first transistor, the fourth terminal of the pull-down unit is a third electrode of the fourth transistor, the fifth terminal of the pull-down unit is a clock signal input terminal, and the sixth terminal of the pull-down unit is a third electrode of the third transistor. The driving method includes: during a first stage T1, a low-level signal is input into the level signal input terminal, a high-level signal is input into the clock signal input terminal, the pull-up unit is turned on and the pull-down unit is turned off by turning on the first transistor and the second transistor and turning off the third transistor and the fourth transistor. In addition, a high-level signal from the first voltage signal is transmitted to the second electrode of the third transistor and to the signal output terminal. The third transistor is turned off, and a high-level signal is output from the signal output terminal steadily. During a second stage T2, a high-level signal is input into the level signal input terminal, a low-level signal is input into the clock signal input terminal, the pull-up unit is turned, off and the pull-down unit is turned on by turning off the first transistor and the second transistor and turning on the third transistor and the fourth transistor. In addition, a low-level signal input into the second power supply input terminal is transmitted to the second electrode of the third transistor via the fourth transistor, the third transistor is turned on, and the fourth transistor is in an on-state until a level of the second electrode of the third transistor becomes VSS+Vth. Furthermore, an output signal from the signal output terminal is changed into a low-level signal from a high-level signal as a result of the first electrode of the third transistor being connected to the second power supply input terminal, a level of the second electrode of the third transistor is further pulled down due to a coupling of the first capacitor, the third transistor is turned on, and a low-level signal input into the second power supply input terminal is transmitted to the signal output terminal integrally. During a third stage T3, the first transistor, the second transistor and the fourth transistor each are turned off, the low level of the second electrode of the third transistor during the second stage T2 is maintained due to the first capacitor, the third transistor maintains an on-state, and the signal output terminal maintains a low-level signal. During a fourth stage T4, in response to a low-level signal being input into the clock signal input terminal, an electrode of the fourth transistor connected to the second electrode of the third transistor becomes a drain electrode due to the low level of the second electrode of the third transistor, the fourth transistor is in an off-state, the second electrode of the third transistor maintains the low level due to the first capacitor, the third transistor keeps in the on-state, and the third transistor continues transmitting the low-level signal to the signal output terminal.

Another inventive aspect is a driving method for an inverting circuit. The inverting circuit includes a pull-up unit including a first power supply input terminal, where the first power supply input terminal is configured to receive a first voltage signal. The pull-up unit also includes first, second, and third terminals. The first terminal is configured to receive a first control signal, and the third terminal is electrically connected to a signal output terminal and configured to output a first level signal. The inverting circuit also includes a pull-down unit including a second power supply input terminal, and fourth, fifth, and sixth terminals. The fourth terminal is electrically connected to the second terminal of the pull-up unit, the second power supply input terminal is configured to receive a second voltage signal, and the fifth terminal is configured to receive a second control signal. In addition, the sixth terminal is electrically connected to the signal output terminal and is configured to output a second level signal. The inverting circuit also includes a first capacitor, where a first terminal of the first capacitor is electrically connected to the second terminal of the pull-up unit and the fourth terminal of the pull-down unit, and a second terminal of the capacitor is electrically connected to the third terminal of the pull-up unit and the sixth terminal of the pull-down unit. The first transistor, the second transistor, the third transistor and the fourth transistor each are P-type transistors. The first terminal of the pull-up unit is a level signal input terminal, the second terminal of the pull-up unit is a first electrode of the second transistor, the third terminal of the pull-up unit is a first electrode of the first transistor, the fourth terminal of the pull-down unit is a third electrode of the fourth transistor, the fifth terminal of the pull-down unit is a clock signal input terminal and the sixth terminal of the pull-down unit is a third electrode of the third transistor. The driving method includes: during a first stage T1, a high-level signal is input into the level signal input terminal, a low-level signal is input into the clock signal input terminal, the pull-down unit is turned on and the pull-up unit is turned off by turning off the first transistor and the second transistor and turning on the third transistor and the fourth transistor, a low-level signal from the second voltage signal is transmitted to the second electrode of the first transistor and to the signal output terminal, the first transistor is turned off, and a low-level signal is output from the signal output terminal. During a second stage T2 a low-level signal is input into the level signal input terminal, a high-level signal is input into the clock signal input terminal, the pull-down unit is turned off and the pull-up unit is turned on by turning on the first transistor and the second transistor and turning off the third transistor and the fourth transistor, a high-level signal input into the first power supply input terminal is transmitted to the second electrode of the first transistor via the second transistor, the first transistor is turned on, the second transistor maintains an on-state until a level of the second electrode of the first transistor becomes VDD−Vth, an output signal from the signal output terminal is changed into a high-level signal from a low-level signal as a result of the first electrode of the first transistor being connected to the first power supply input terminal, a level of the first terminal of the first capacitor, and a level of the second electrode of the first transistor are further pulled up due to a coupling of the first capacitor, the first transistor is turned on, the high-level signal input into the first power supply input terminal is transmitted to the signal output terminal integrally. During a third stage T3 the second transistor, the third transistor, and the fourth transistor each are turned off, the high level of the second electrode of the first transistor during the second stage T2 is maintained due to the first capacitor, the first transistor remains in an on-state, and the signal output terminal keeps outputting a high-level signal. During a fourth stage T4 when a high-level signal is input into the clock signal input terminal, an electrode of the second transistor connected to the second electrode of the first transistor becomes a source electrode due to the high level of the second electrode of the first transistor, the second transistor is in an off-state, the second electrode of the first transistor remains at high level due to the first capacitor, the first transistor remains in the on-state, and the first transistor continues transmitting the high-level signal to the signal output terminal.

BRIEF DESCRIPTION OF THE DRAWINGS

In order to illustrate the technical solutions according to the embodiments of the present invention or in the prior art more clearly, drawings to be used in the description of the prior art or the embodiments will be described briefly hereinafter. Apparently, the drawings described hereinafter are only a few of embodiments of the present invention, and other drawings may be obtained by those skilled in the art according to those drawings without creative labor.

DETAILED DESCRIPTION OF THE EMBODIMENTS

Hereinafter, the technical solution in the embodiment of the present invention will be described clearly and completely in conjunction with the drawings in the embodiment of the present invention. Apparently, the described embodiments are only a few of the embodiments of the present invention, but not all the embodiments. All the other embodiments obtained by those skilled in the art based on the embodiment in the present invention without creative labor will fall within the scope of protection of the present invention.

Figure 1A:
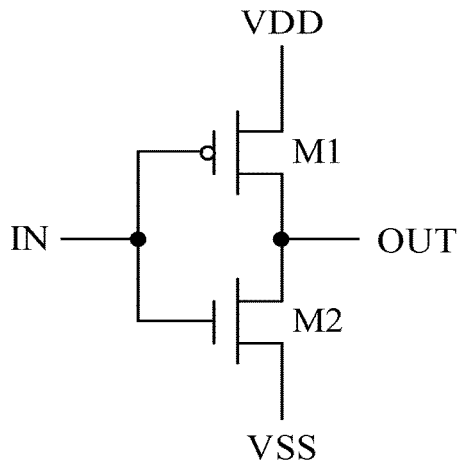
FIG. 1a (Prior Art)
FIG. 1*a* is a structural diagram of a CMOS inverting circuit in the conventional art.
Figure 1B:
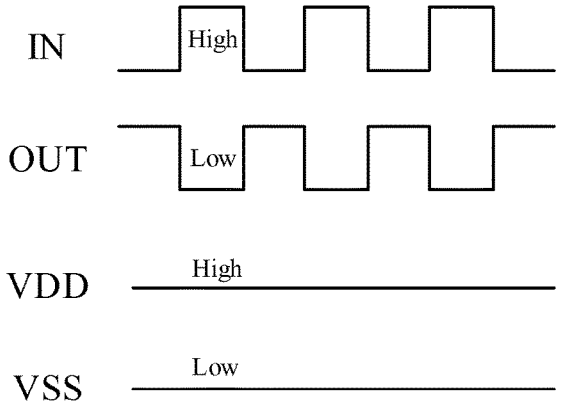
FIG. 1b (Prior Art)
FIG. 1*b* is a control timing diagram of the CMOS inverting circuit in FIG. 1*a;*
Figure 2A:
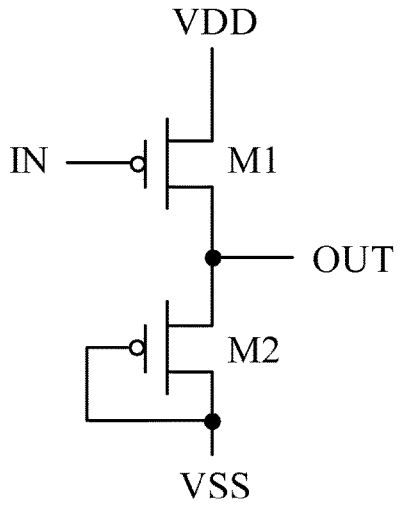
FIG. 2a (Prior Art)
FIG. 2*a* is a structural diagram of a pure PMOS inverting circuit in the conventional art.
Figure 2B:
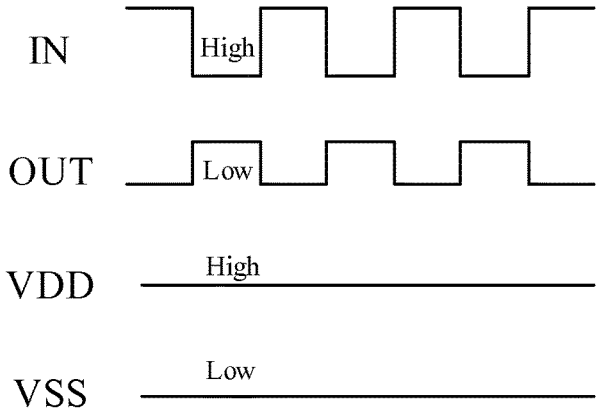
FIG. 2b (Prior Art)
FIG. 2*b* is a control timing diagram of the pure PMOS inverting circuit in FIG. 2*a;*
Figure 3A:
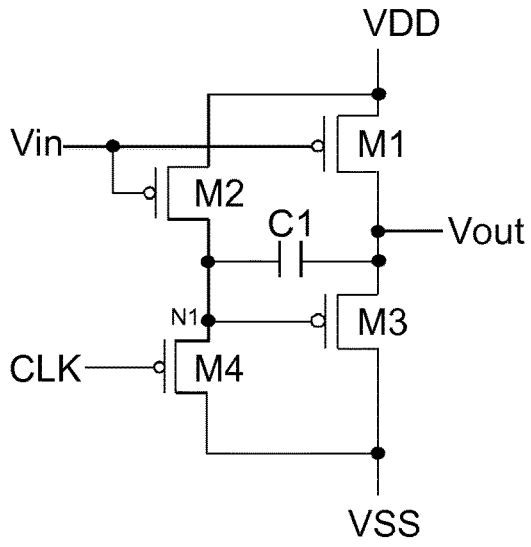
FIG. 3*a* is a structural diagram of an inverting circuit according to an embodiment of the invention.

FIG. 3*a* is a structural diagram of an inverting circuit according to an embodiment of the invention. The inverting circuit includes a first transistor M1, a second transistor M2, a third transistor M3, a fourth transistor M4 and a first capacitor C1. The first transistor M1, the second transistor M2, the third transistor M3 and the fourth transistor M4 each are P-type transistors.

A first electrode of the first transistor M1 is connected to a second terminal of the first capacitor C1 and a third electrode of the third transistor M3, and is connected to a signal output terminal Vout together with the second terminal of the first capacitor C1 and the third electrode of the third transistor M3; a second electrode of the first transistor M1 is connected to a second electrode of the second transistor M2, and is connected to a level signal input terminal Vin together with the second electrode of the second transistor M2; a third electrode of the first transistor M1 is connected to a third electrode of the second transistor M2, and is connected to a first power supply input terminal VDD together with the third electrode of the second transistor M2.

A first electrode of the second transistor M2, a second electrode of the third transistor M3 and a third electrode of the fourth transistor M4 are connected at an node N1, and are connected to a first terminal of the first capacitor C1; the second electrode of the second transistor M2 is connected to the second electrode of the first transistor M1, and is connected to the level signal input terminal Vin together with the second electrode of the first transistor M1; a third electrode of the second transistor M2 is connected to the third electrode of the first transistor M1, and is connected to the first power supply input terminal VDD together with the third electrode of the first transistor M1.

A first electrode of the third transistor M3 is connected to a first electrode of the fourth transistor M4, and is connected to a second power supply input terminal VSS together with the first electrode of the fourth transistor M4; the second electrode of the third transistor M3, the third electrode of the fourth transistor M4 and the first terminal of the first capacitor C1 are connected at the node N1; the third electrode of the third transistor M3 is connected to the first electrode of the first transistor M1 and the second terminal of the first capacitor C1, and is connected to the signal output terminal Vout together with the first electrode of the first transistor M1 and the second terminal of the first capacitor C1.

The first electrode of the fourth transistor M4 is connected to the first electrode of the third transistor M3, and is connected to the second power supply input terminal VSS together with the first electrode of the third transistor M3; a second electrode of the fourth transistor M4 is connected to a clock signal input terminal CLK; the third electrode of the fourth transistor M4, the second electrode of the third transistor M3 and the first terminal of the first capacitor C1 are connected at the node N1.

Figure 3B:
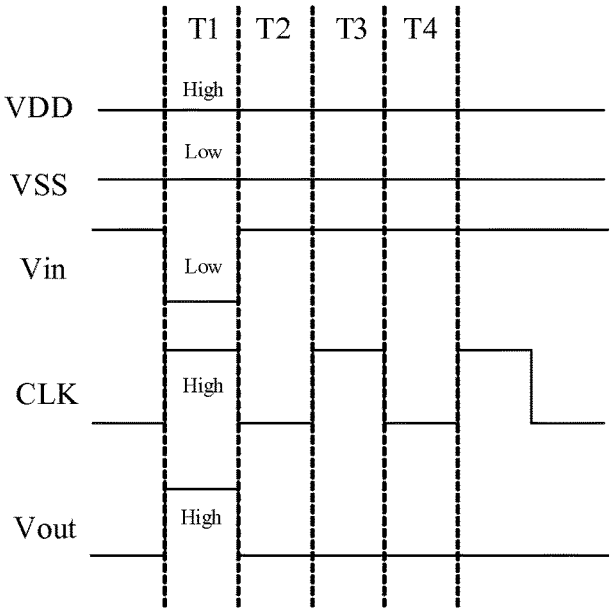
FIG. 3*b* is a control timing diagram of the inverting circuit in FIG. 3*a;*

FIG. 3*b* is a control timing diagram of the inverting circuit in FIG. 3*a*.

During a first stage T1, a low-level signal is input into the level signal input terminal Vin, a high-level signal is input into the clock signal input terminal CLK. A pull-up unit is turned on and a pull-down unit is turned off, i.e., the first transistor M1 and the second transistor M2 each are turned on and the third transistor M3 and the fourth transistor M4 each are turned off. Because of turning on the first transistor M1 and the second transistor M2, a high-level signal of the first supply voltage VDD is transmitted to the node N1 and the signal output terminal Vout respectively, the third transistor M3 is turned off completely, and a high-level signal is output from the signal output terminal steadily.

During a second stage T2, a high-level signal is input into the level signal input terminal Vin, a low-level signal is input into the clock signal input terminal CLK. The pull-up unit is turned off and the pull-down unit is turned on, i.e., the first transistor M1 and the second transistor M2 each are turned off and the third transistor M3 and the fourth transistor M4 each are turned on. Because of turning on the fourth transistor M4, a low-level signal from the second power supply input terminal VSS is transmitted to the node N1 from the fourth transistor M4, and the third transistor M3 is turned on. The fourth transistor M4 is in the on-state until a level of the node N1 becomes VSS+Vth, and an output signal from the signal output terminal Vout is changed into a low-level signal from a high-level signal since the first electrode of the third transistor M3 is connected to the second power supply input terminal VSS. The level of the second terminal of the first capacitor C1, the level of the node N1, is further pulled down due to the coupling function of the first capacitor C1, the third transistor M3 is turned on completely, and the low-level signal from the second power supply input terminal VSS is transmitted to the signal output terminal Vout integrally.

During a third stage 13 in which the CLK and the Vin each are in high level, the first transistor M1, the second transistor M2 and the fourth transistor M4 each are turned off. The low level of the node N1 in the previous stage (the second stage T2) is kept due to the first capacitor C1, therefore, the third transistor M3 keeps in the complete on-state, and the signal output terminal Vout keeps outputting the low-level signal.

During a fourth stage T4, when the CLK is in the low level again, the electrode of the fourth transistor M4 connected to the node N1 becomes a drain electrode due to the low level of the node N1, the fourth transistor M4 keeps in the off-state for a long time the node N1 keeps in the low level due to the first capacitor the third transistor M3 keeps in the complete on-state, and the third transistor M3 keeps transmitting the low-level signal to the signal output terminal Vout integrally for a long time.

Figure 3C:
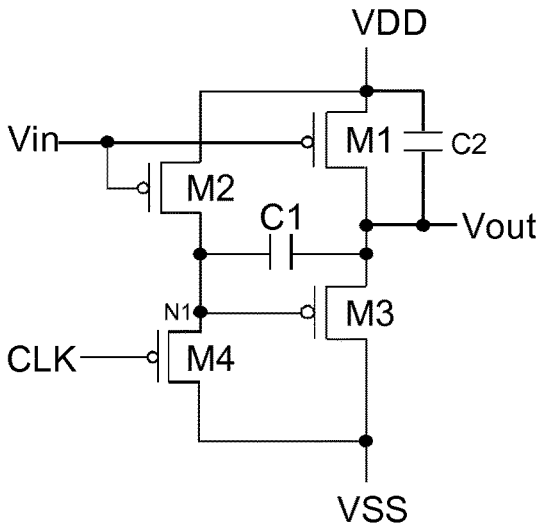
FIGS. 3*c* to 3*e* are structural diagrams of another inverting circuit according to an embodiment of the invention.

In this embodiment, the inverting circuit may further include a second capacitor C2, as shown in FIG. 3*c*. A first terminal of the second capacitor C2 is connected to the third electrode of the first transistor M1, and is connected to the first power supply input terminal VDD together with the third electrode of the first transistor M1; and a second terminal of the second capacitor C2 is connected to the signal output terminal Vout. The driving manner of the inverting circuit shown in FIG. 3C is the same as that shown FIG. 3*a*, and is shown in FIG. 3*b*. The advantage of adding the second capacitor C2 lies in that the Vout can be kept as a stable output of low level for a long time without being affected by other factors.

Figure 3D:
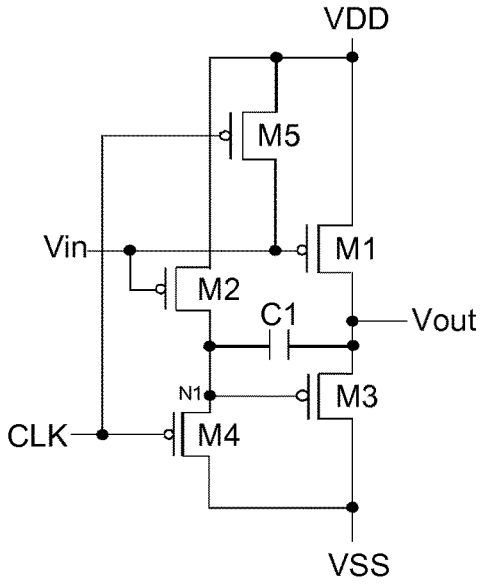

In this embodiment, the inverting circuit may further include a fifth transistor M5, as shown, in FIG. 3*d*. A first electrode of the fifth transistor M5 is connected to the second electrode of the first transistor M1 and the second electrode of the second transistor M2, and is connected to the level signal input terminal Vin together with the second electrode of the first transistor M1 and the second electrode of the second transistor M2; a second electrode of the fifth transistor M5 is connected to the second electrode of the fourth transistor M4, and is connected to the clock signal input terminal CLK together with the second electrode of the fourth transistor M4; a third electrode of the fifth transistor M5 is connected to the third electrode of the first transistor M1, and is connected to the first power supply input terminal VDD together with the third electrode of the first transistor M1. The driving manner of the inverting circuit shown in FIG. 3*d* is the same as that shown in FIG. 3*a*, and is shown in FIG. 3*b*. The advantage of adding the fifth transistor M5 lies in that the VDD can be transmitted to the second electrode of the first transistor M1 when the CLK is in low level, so that the first transistor M1 is turned off completely, and negative factors leading to the un-complete turning off of the first transistor M1 and affecting the outputting of the low level can be avoided.

Figure 3E:
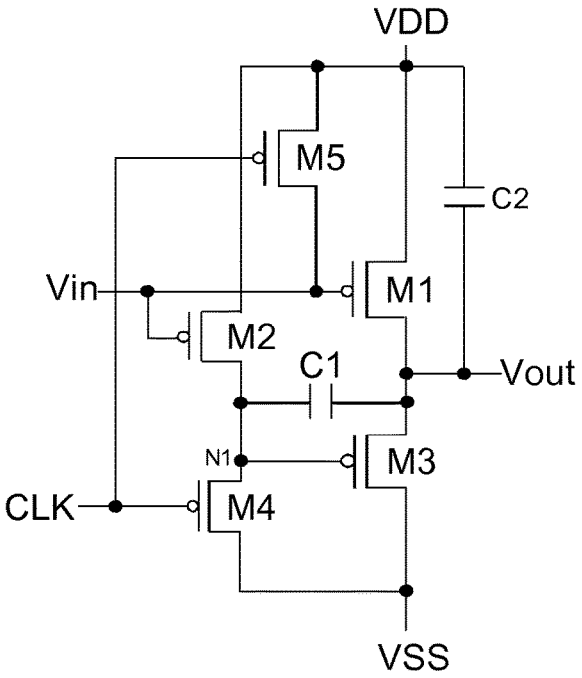

In this embodiment, the inverting circuit may include both the second capacitor C2 and the fifth transistor M5, as shown in FIG. 3*e*. The connection relation between the second capacitor C2 and the fifth transistor M5 is the same as the above connection relation, and the driving manner is also the same as above, as shown in FIG. 3*b*.

Figure 4A:
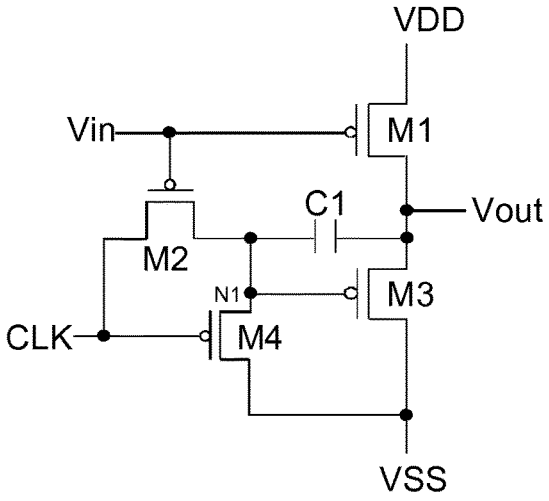
FIG. 4*a* is a structural diagram of an inverting circuit according to an embodiment of the invention.

FIG. 4*a* is a structural diagram of an inverting circuit according to an embodiment of the invention. The inverting circuit includes a first transistor M1, a second transistor M2, a third transistor M3, a fourth transistor M4 and a first capacitor C1. The first transistor M1, the second transistor M2, the third transistor M3 and the fourth transistor M4 each are P-type transistors.

A first electrode of the first transistor M1 is connected to a second terminal of the first capacitor C1 and a third electrode of the third transistor M3, and is connected to a signal output terminal Vout together with the second terminal of the first capacitor C1 and the third electrode of the third transistor M3; a second electrode of the first transistor M1 is connected to a second electrode of the second transistor M2, and is connected to a level signal input terminal Vin together with the second electrode of the second transistor M2; a third electrode of the first transistor M1 is connected to a first power supply input terminal VDD.

A first electrode of the second transistor M2 is connected to a second electrode of the fourth transistor M4, and is connected to the clock signal input terminal CLK together with the second electrode of the fourth transistor M4; the second electrode of the second transistor M2 is connected to the second electrode of the first transistor M1, and is connected to the level signal input terminal Vin together with the second electrode of the first transistor M1; the third electrode of the second transistor M2, a second electrode of the third transistor M3 and a third electrode of the fourth transistor M4 are connected at a node N1, and are connected to the first terminal of the first capacitor C1.

A first electrode of the third transistor M3 is connected to a first electrode of the fourth transistor M4, and is connected to a second power supply input terminal VSS together with the first electrode of the fourth transistor M4; the second electrode of the third transistor M3, the third electrode of the fourth transistor M4 and the first terminal of the first capacitor C1 are connected at the node N1; the third electrode of the third transistor M3 is connected to the first electrode of the first transistor M and the second terminal of the first capacitor C1, and is connected to the signal output terminal Vain together with the first electrode of the first transistor M1 and the second terminal of the first capacitor C1.

The first electrode of the fourth transistor M4 is connected to the first electrode of the third transistor M3, and is connected to the second power supply input terminal VSS together with the first electrode of the third transistor M3; the second electrode of the fourth transistor M4 is connected to the first electrode of the second transistor M2, and is connected to the clock signal input terminal CLK together with the first electrode of the second transistor M2; the third electrode of the fourth transistor M4, the second electrode of the third transistor M3 and the third electrode of the second transistor M2 are connected at the node N1, and are connected to the first terminal of the first capacitor C1.

Figure 4B:
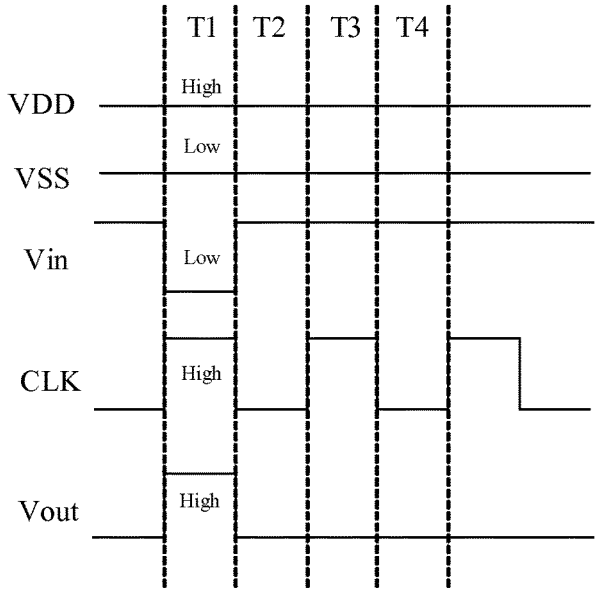
FIG. 4*b* is a control timing diagram of the inverting circuit in FIG. 4*a;*

FIG. 4*b* is a control timing diagram of the inverting circuit in FIG. 4*a*.

During a first stage T1, a low-level signal is input into the level signal input terminal Vin, a high-level signal is input into the clock signal input terminal CLK. A pull-up unit is turned on and the pull-down unit is turned off, i.e., the first transistor M1 and the second transistor M2 each are turned on and the third transistor M3 and the fourth transistor M4 each are turned off. Because of turning on the first transistor M1 and the second transistor M2, a high-level signal of the first supply voltage VDD is transmitted to the node N1 and the signal output terminal Vout respectively, the third transistor M3 is turned off completely, and a high-level signal is output from the signal output terminal steadily.

During a second stage T2, a high-level signal is input into the level signal input terminal Vin, a low-level signal is input into the clock signal input terminal CLK. The pull-up unit is turned off and the pull-down unit is turned on, i.e., the first transistor M1 and the second transistor M2 each are turned off and the third transistor M3 and the fourth transistor M4 each are turned on. Because of turning on the fourth transistor M4, a low-level signal from the second power supply input terminal VSS is transmitted to the node N1 from the fourth transistor M4, and the third transistor M3 is turned on. The fourth transistor M4 is in the on-state until a level of the node N1 becomes VSS+Vth, and an output signal from the signal output terminal Vout is changed into a low-level signal from a high level signal since the first electrode of the third transistor M3 is connected to the second power supply input terminal VSS. The level of the second terminal of the first capacitor C1, i.e., the level of the node N1, is further pulled down due to the coupling function of the first capacitor C1, the third transistor M3 is turned on completely, and the low-level signal from the second power supply input terminal VSS is transmitted to the signal output terminal Vout integrally.

During a third stage T3 in which the CLK and the Vin each are in high level, the first transistor M1, the second transistor M2 and the fourth transistor M4 each are turned off. The low level of the node N1 in the previous time sequence (the second sequence T2) is kept due to the first capacitor C1, therefore, the third transistor M3 keeps in the complete on-state, and the signal output terminal Vout keeps outputting the low-level signal.

During a fourth stage T4, when the CLK is in the low-level signal again, the electrode of the fourth transistor M4 connected to the node N1 becomes a drain electrode due to the low level of the node N1, the fourth transistor M4 keeps in the off-state for a long time, the node N1 keeps in the low level due to the first capacitor C1, the third transistor M3 keeps in the complete on-state, and the third transistor M3 keeps transmitting the low-level signal to the signal output terminal Vout integrally for a long time.

Figure 4C:
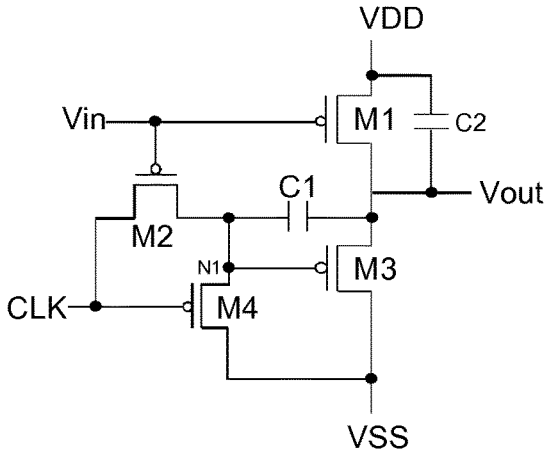
FIGS. 4*c* to 4*e* are structural diagrams of another inverting circuit according to an embodiment of the invention.

In this embodiment, the inverting circuit may further include a second capacitor C2, as shown in FIG. 4*c*. A first terminal of the second capacitor C2 is connected to the third electrode of the first transistor M1, and is connected to the first power supply input terminal VDD together with the third electrode of the first transistor M1; a second terminal of the second capacitor C2 is connected to the signal output terminal Vout. The driving manner of the inverting circuit shown in FIG. 4*c* is the same as that shown in FIG. 4*a*, and is shown in FIG. 4*b*. The advantage of adding the second capacitor C2 lies in that the Vout can be kept as a stable output of low level for a long time without being affected by other factors.

Figure 4D:
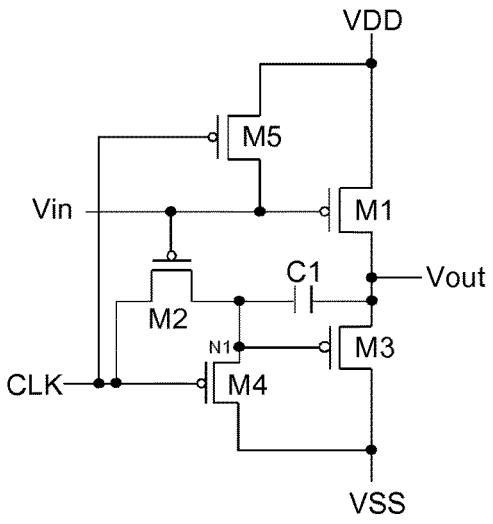

In this embodiment, the inverting circuit may further include a fifth transistor M5, as shown in FIG. 4*d*. A first electrode of the fifth transistor M5 is connected to the second electrode of the first transistor M1 and the second electrode of the second transistor M2, and is connected to the level signal input terminal Vin together with the second electrode of the first transistor M1 and the second electrode of the second transistor M2; a second electrode of the fifth transistor M5 is connected to the second electrode of the fourth transistor M4, and is connected to the clock signal input terminal CLK together with the second electrode of the fourth transistor M4; a third electrode of the fifth transistor M5 is connected to the third electrode of the first transistor M1, and is connected to the first power supply input terminal VDD together with the third electrode of the first transistor M1. The driving manner of the inverting circuit shown in FIG. 4*d* is the same as that shown in FIG. 4*a*, and is shown in FIG. 4*b*. The advantage of adding the fifth transistor M5 lies in that the VDD can be transmitted to the second electrode of the first transistor M1 when the CLK is in low level, so that the first transistor M1 is turned off completely, and negative factors leading to the un-complete turning off of the first transistor M1 and affecting the outputting of the low level on the input line can be avoided.

Figure 4E:
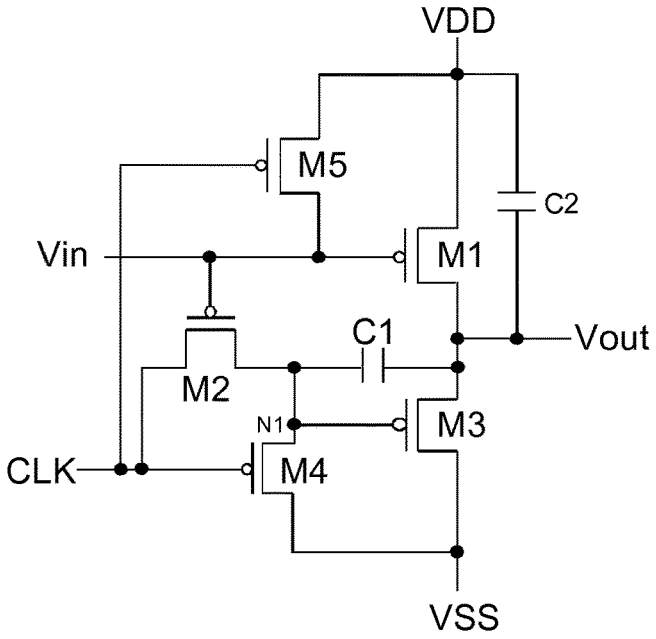

In this embodiment, the inverting circuit may include both the second capacitor C2 and the fifth transistor M5, as shown in FIG. 4*e*. The connection relation between the second capacitor C2 and the fifth transistor M5 is the same as the above connection relation, and the driving manner is also the same as above, as shown in FIG. 4*b*.

Figure 5A:
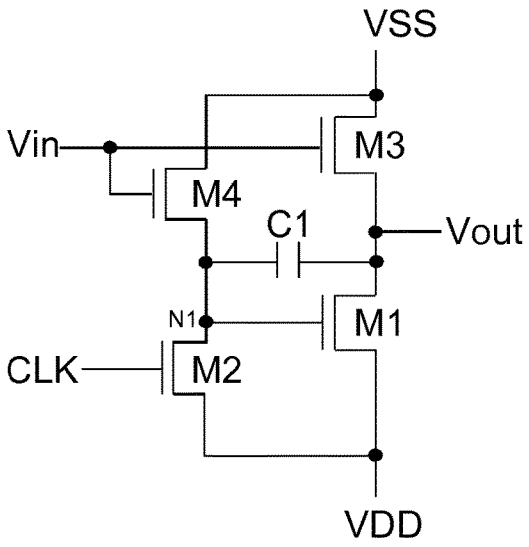
FIG. 5*a* is a structural diagram of an inverting circuit according to an embodiment of the invention.

FIG. 5*a* is a structural diagram of an inverting circuit according to an embodiment of the invention. The inverting circuit includes a first transistor M1, a second transistor M2, a third transistor M3, a fourth transistor M4 and a first capacitor C1. The first transistor M1, the second transistor M2, the third transistor M3 and the fourth transistor M4 each are N-type transistors.

A first electrode of the first transistor M1 is connected to a first electrode of the second transistor M2, and is connected to a first power supply input terminal Vin together with the first electrode of the second transistor M2; a second electrode of the first transistor M1, a third electrode of the second transistor M2 and a first electrode of the fourth transistor M4 are connected at a node N1, and are connected to a first terminal of the first capacitor C1; a third electrode of the first transistor M1 is connected to a first electrode of the third transistor M3 and a second terminal of the first capacitor C1, and is connected to a signal output terminal Vout together with the first electrode of the third transistor M3 and the second terminal of the first capacitor 1.

The first electrode of the second transistor M2 is connected to the first electrode of the first transistor M1, and is connected to the first power supply input terminal Vin together with the first electrode of the first transistor M1; a second electrode of the second transistor M2 is connected to a clock signal input terminal CLK; the third electrode of the second transistor M2, the second electrode of the first transistor M1 and the first electrode of the fourth transistor M4 are connected at the node N1, and are connected to the first terminal of the first capacitor C1.

The first electrode of the third transistor M3 is connected to the third electrode of the first transistor M1 and a second terminal of the first capacitor C1, and is connected to the signal output terminal Vout together with the third electrode of the first transistor M1 and the second terminal of the first capacitor C1; a second electrode of the third transistor M3 is connected to a second electrode of the fourth transistor M4, and is connected to the level signal input terminal Vin together with the second electrode of the fourth transistor M4; a third electrode of the third transistor M3 is connected to a third electrode of the fourth transistor M4, and is connected to a second power supply input terminal VSS together with the third electrode of the fourth transistor M4.

Figure 5B:
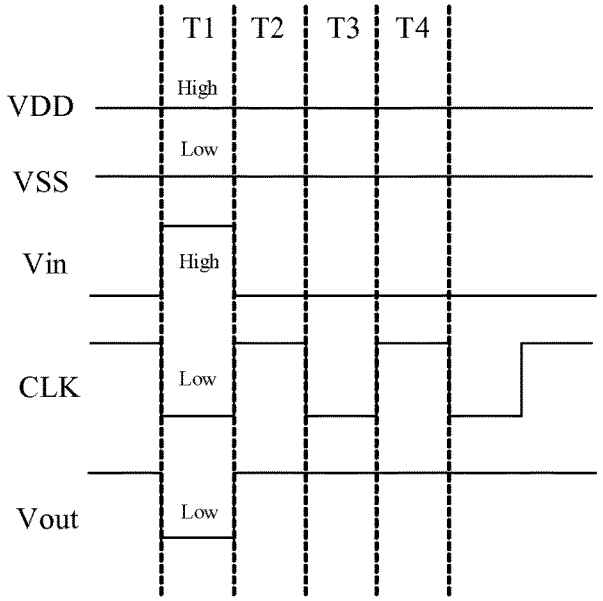
FIG. 5*b* is a control timing diagram of the inverting circuit in FIG. 5*a;*

The first electrode of the fourth transistor M4, the third electrode of the second transistor M2 and the second electrode of the first transistor M1 are connected at the node N1, and are connected to the first terminal of the first capacitor C1; the second electrode of the fourth transistor M4 is connected to the second electrode of the third transistor M3, and is connected to the level signal input terminal Vin together with the second electrode of the third transistor M3; the third electrode of the fourth transistor M4 is connected to the third electrode of the third transistor M3, and is connected to the second power supply input terminal VSS together with the third electrode of the third transistor M3. FIG. 5*b* is a control timing diagram of the inverting circuit in FIG. 5*a*.

During a first stage T1, a high-level signal is input into the level signal input terminal Vin, a low-level signal is input into the clock signal input terminal CLK. A pull-down unit is turned on and a pull-up unit is turned off, i.e., the first transistor M1 and the second transistor M2 each are turned off and the third transistor M3 and the fourth transistor M4 each are turned on. Because of turning on the third transistor M3 and the fourth transistor M4, a low-level signal of the second supply voltage VSS is transmitted to the node N1 and the signal output terminal Vout respectively, the first transistor M1 is turned off completely, and a low-level signal is output from the signal output terminal Vout steadily.

During a second stage T2, a low-level signal is input into the level signal input terminal Vin, a high-level signal is input into the clock signal input terminal CLK. The pull-down unit is turned off and the pull-up unit is turned on, i.e., the first transistor M1 and the second transistor M2 each are turned on and the third transistor M3 and the fourth transistor M4 each are turned off Because of turning on the second transistor M2, a high-level signal from the first power supply input terminal VDD is transmitted to the node N1 from the second transistor M2, and the first transistor M1 is turned on. The second transistor M2 is on the on state until a level of the node N1 becomes VDD−Vth, and an output signal from the signal output terminal Vout is changed into a high-level signal from a low-level signal since the first electrode of the first transistor M1 is connected to the first power supply input terminal VDD. The level of the first terminal of the first capacitor C1, i.e., the level of the node N1, is further pulled up due to the coupling function of the first capacitor C1, the first transistor M1 is turned on completely, and the high-level signal from the first power supply input terminal VDD is transmitted to the signal output terminal Vout integrally.

During a third stage T3 in which the CLK and the Vin each are in low level, the second transistor M2, the third transistor M3 and the fourth transistor M4 each are turned off. The high level of the node N1 in the previous time sequence (the second sequence T2) is kept due to the first capacitor C1, therefore, the first transistor M1 keeps in the complete on-state, and the signal output terminal Vout keeps outputting the high-level signal.

During a fourth stage T4, when the CLK is in the high level again, the electrode of the second transistor M2 connected to the node N1 becomes a source electrode due to the high level of the node N1, the second transistor M2 keeps in the off-state for a long time, the node N1 keeps in the high level due to the first capacitor C1, the first transistor M1 keeps in the complete on-state, and the first transistor M1 keeps transmitting the high-level signal to the signal output terminal Vout integrally for a long time until a next effective input arrives.

Figure 5C:
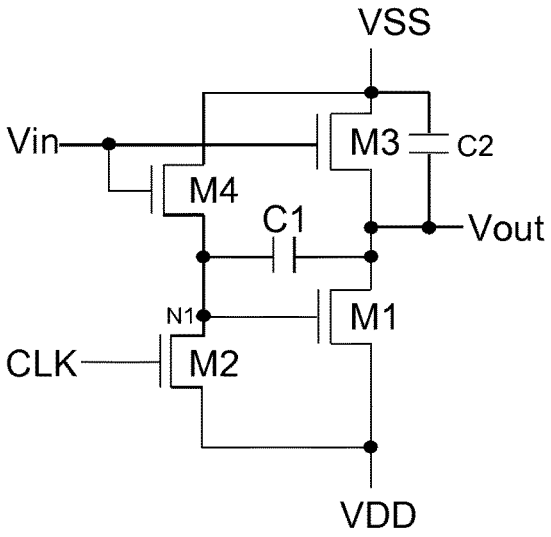
FIGS. 5*c* to 5*e* are structural diagrams of another inverting circuit according to an embodiment of the invention.

In this embodiment, the inverting circuit may further include a second capacitor C2, as shown in FIG. 5*c*. A first terminal of the second capacitor C2 is connected to the third electrode of the third transistor M3, and is connected to the second power supply input terminal VSS together with the third electrode of the third transistor M3; a second terminal of the second capacitor C2 is connected to the signal output terminal Vout. The driving manner of the inverting circuit shown in FIG. 5*c* is the same as that shown in FIG. 5*a*, and is shown in FIG. 5*b*. The advantage of adding the second capacitor C2 lies in that the Vout can be kept as a stable output of high level for a long time without being affected by other factors.

Figure 5D:
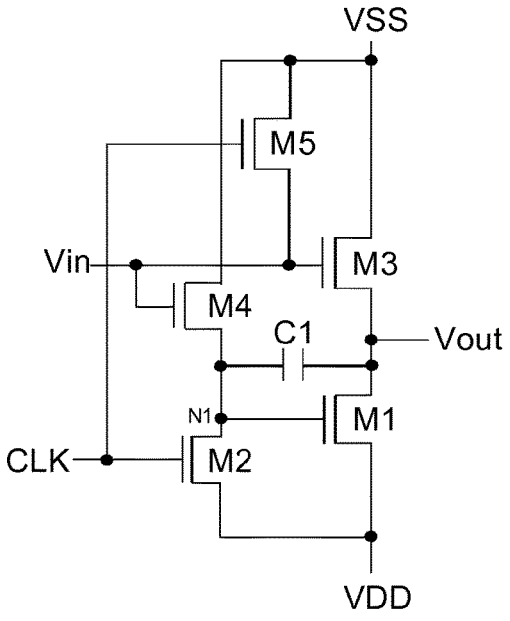

In this embodiment, the inverting circuit may further include a fifth transistor M5, as shown in FIG. 5*d*. A first electrode of the fifth transistor M5 is connected to the second electrode of the third transistor M3 and the second electrode of the fourth transistor M4, and is connected to the level signal input terminal Vin together with the second electrode of the third transistor M3 and the second electrode of the fourth transistor M4 a second electrode of the fifth transistor M5 is connected to the second electrode of the second transistor M2, and is connected to the clock signal input terminal CLK together with the second electrode of the second transistor M2; a third electrode of the fifth transistor M5 is connected to the third electrode of the third transistor M3, and is connected to the second power supply input terminal VSS together with the third electrode of the third transistor M3. The driving manner of the inverting circuit shown in FIG. 5*d* is the same as that shown in FIG. 5*a*, and is shown in FIG. 5*b*. The advantage of adding the fifth transistor M5 lies in that the VSS can be transmitted to the second electrode of the third transistor M3 when the CLK is in high level, so that the third transistor M3 is turned off completely, and negative factors leading to the un-complete turning off of the third transistor M3 and affecting the outputting of the low level on the input line can be avoided.

Figure 5E:
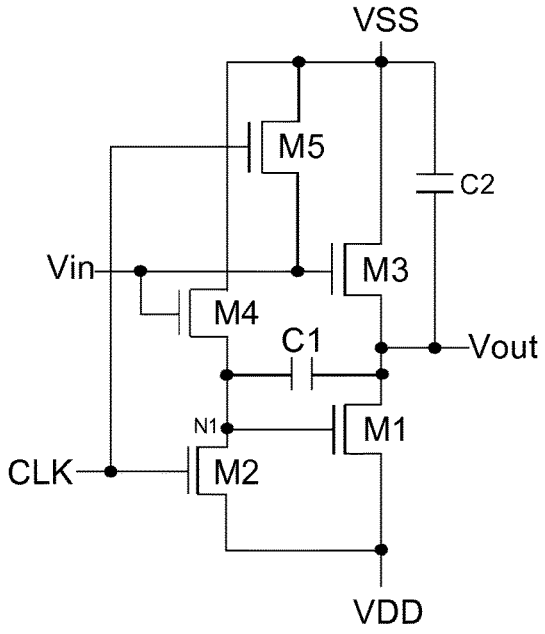

In this embodiment, the inverting circuit may include both the second capacitor C2 and the fifth transistor M5, as shown in FIG. 5*e*. The connection relation between the second capacitor C2 and the fifth transistor M5 is the same as the above connection relation, and the driving manner is also the same as above, as shown in FIG. 5*b*.

Figure 6A:
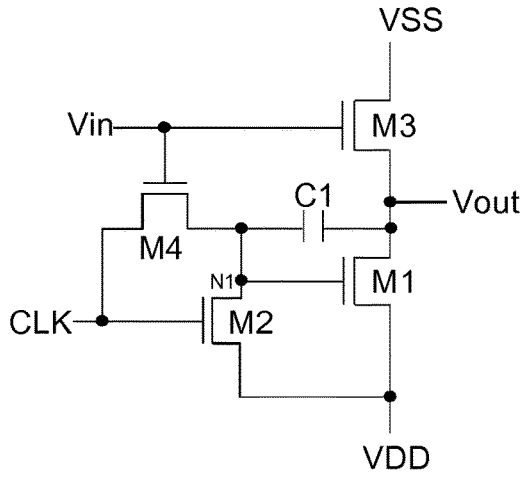
FIG. 6*a* is a structural diagram of an inverting circuit according to an embodiment of the invention.

FIG. 6*a* is a structural diagram of an inverting circuit according to an embodiment of the invention. The inverting circuit includes a first transistor M1, a second transistor M2, a third transistor M3, a fourth transistor M4 and a first capacitor C1. The first transistor M1, the second transistor M2, the third transistor M3 and the fourth transistor M4 each are N-type transistors.

A first electrode of the first transistor M1 is connected to a first electrode of the second transistor M2, and is connected to a first power supply input terminal Vin together with the first terminal of the second transistor M2; a second electrode of the first transistor, a third electrode of the second transistor M2 and a electrode of the fourth transistor M4 are connected at a node N1, and are connected to a first terminal of the first capacitor C1; a third electrode of the first transistor M1 is connected to a first electrode of the third transistor M3 and a second terminal of the first capacitor C1, and is connected to a signal output terminal Vout together with the first electrode of the third transistor M3 and the second terminal of the first capacitor 1.

The first electrode of the second transistor M2 is connected to the first electrode of the first transistor M1, and is connected to the first power supply input terminal Vin together with the first electrode of the first transistor M1; a second electrode of the second transistor M2 is connected to a clock signal input terminal CLK; the third electrode of the second transistor M2, the second electrode of the first transistor M1 and the first electrode of the fourth transistor M4 are connected at the node N1, and are connected to the first terminal of the first capacitor C1.

The first electrode of the third transistor M3 is connected to the third electrode of the first transistor M1 and a second terminal of the first capacitor C1, and is connected to the signal output terminal Vout together with the third electrode of the first transistor M1 and the second terminal of the first capacitor C1; a second electrode of the third transistor M3 is connected to a second electrode of the fourth transistor M4, and is connected to the level signal input terminal Vin together with the second electrode of the fourth transistor M4; a third electrode of the third transistor M3 is connected to a second power supply input terminal VSS. The first third electrode of the fourth transistor M4 is connected to the second electrode of the second transistor M2, and is connected to the clock signal input terminal CLK together with the second electrode of the second transistor M2; the second electrode of the fourth transistor M4 is connected to the second electrode of the third transistor M3, and is connected to the level signal input terminal Vin together with the second electrode of the third transistor M3; the first electrode of the fourth transistor M4, the second electrode of the first transistor M1 and the third electrode of the second transistor M2 are connected at the node N1, and are connected to the first terminal of the first capacitor C1.

Figure 6B:
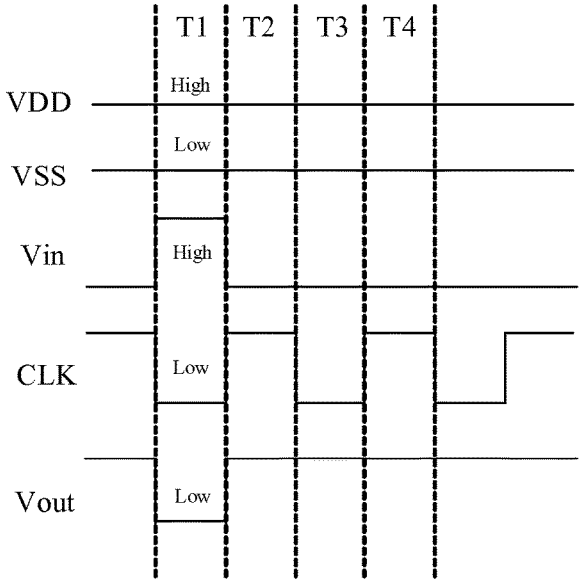
FIG. 6*b* is a control timing diagram of the inverting circuit in FIG. 6*a*.

FIG. 6*b* is a control timing diagram of the inverting circuit in FIG. 6*a*.

During a first time sequence T1, a high-level signal is input into the level signal input terminal Vin, a low-level signal is input into the clock signal input terminal CLK. A pull-down unit is turned on and a pull-up unit is turned off, i.e., the first transistor M1 and the second transistor M2 each are turned off and the third transistor M3 and the fourth transistor M4 each are turned on. Because of turning on the third transistor M3 and the fourth transistor M4, a low-level signal of the second supply voltage VSS is transmitted to the node N1 and the signal output terminal Vout respectively, the first transistor M1 is turned off completely, and a low-level signal is output from the signal output terminal Vout steadily.

During a second stage T2, a low-level signal is input into the level signal input terminal Vin, a high-level signal is input into the clock signal input terminal CLK. The pull-down unit is turned off and the pull-up unit is turned on, i.e., the first transistor M1 and the second transistor M2 each are turned on and the third transistor M3 and the fourth transistor M4 each are turned off. Because of turning on the second transistor M2, a high-level signal from the first power supply input terminal VDD is transmitted to the node N1 from the second transistor M2, and the first transistor M1 is turned on. The second transistor M2 is in the on-state until a level of the node N1 becomes VDD−Vth, and an output signal from the signal output terminal Vout is changed into a high-level signal from a low-level signal since the first electrode of the first transistor M1 is connected to the first power supply input terminal VDD. The level of the first terminal of the first capacitor C1, i.e., the level of the node N1, is further pulled up due to the coupling function of the first capacitor C1, the first transistor M1 is turned on completely, and the high-level signal from the first power supply input terminal VDD is transmitted to the signal output terminal Vout integrally.

During a third stage T3 in which the CLK and the Vin each are in low level, the second transistor M2, the third transistor M3 and the fourth transistor M4 each are turned off. The high level of the node N1 in the previous time sequence (the second sequence T2) is kept due to the first capacitor C1, therefore, the first transistor M1 keeps in the complete on-state, and the signal output terminal Vout keeps outputting the high-level signal.

During a fourth stage T4, when the CLK is in the low level again, the electrode of the second transistor M2 connected to the node N1 becomes a source electrode due to the high level of the node N1, the second transistor M2 keeps in the off-state for a long time, the node N1 keeps in the high level due to the first capacitor C1, the first transistor M1 keeps in the complete on-state, and the first transistor M1 keeps transmitting the high-level signal to the signal output terminal Vout integrally for a long time until a next effective input signal arrives.

Figure 6C:
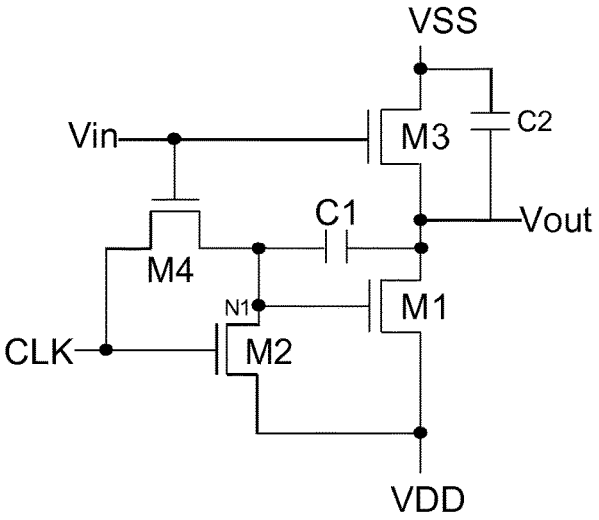
FIGS. 6*c* to 6*e* are structural diagrams of another inverting circuit according to an embodiment of the invention.

In this embodiment, the inverting circuit may further include a second capacitor C2, as shown in FIG. 6*c*. A first terminal of the second capacitor C2 is connected to the third electrode of the third transistor M3, and is connected to the second power supply input terminal VSS together with the third electrode of the third transistor M3; a second terminal of the second capacitor C2 is connected to the signal output terminal Vout. The driving manner of the inverting circuit shown in FIG. 6*c* is the same as that shown in FIG. 6*a*, and is shown in FIG. 6*b*. The advantage of adding the second capacitor C2 lies in that the Vout can be kept as a stable output of high level for a long time without being affected by other factors.

Figure 6D:
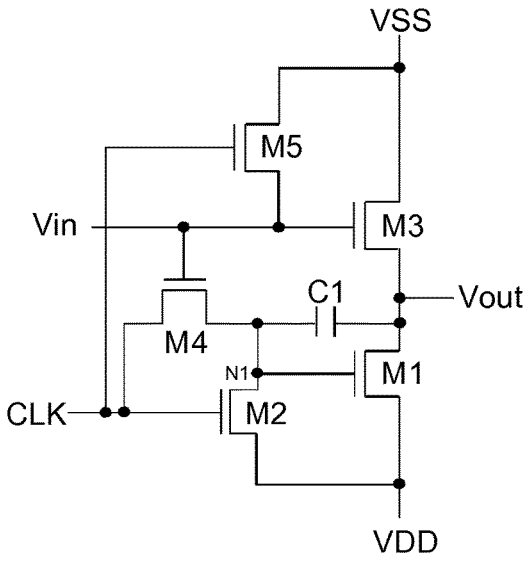

In this embodiment, the inverting circuit may further include a fifth transistor M5, as shown in FIG. 6*d*. A first electrode of the fifth transistor M5 is connected to the second electrode of the third transistor M3 and the second electrode of the fourth transistor M4, and is connected to the level signal input terminal Vin together with the second electrode of the third transistor M3 and the second electrode of the fourth transistor M4; a second electrode of the fifth transistor M5 is connected to the second electrode of the second transistor M2, and is connected to the clock signal input terminal CLK together with the second electrode of the second transistor M2; a third electrode of the fifth transistor M5 is connected to the third electrode of the third transistor M3, and is connected to the second power supply input terminal VSS together with the third electrode of the third transistor M3. The driving manner of the inventing circuit shown in FIG. 6*d* is the same as that shown in FIG. 6*a*, and is shown in FIG. 6*b*. The advantage of adding the fifth transistor M5 lies in that the VSS can be transmitted to the second electrode of the third transistor M3 when the CLK is in high level, so that the third transistor M3 is turned off completely, and negative factors leading to the un-complete turning off of the third transistor M3 and affecting the outputting of the low level in the input can be avoided.

Figure 6E:
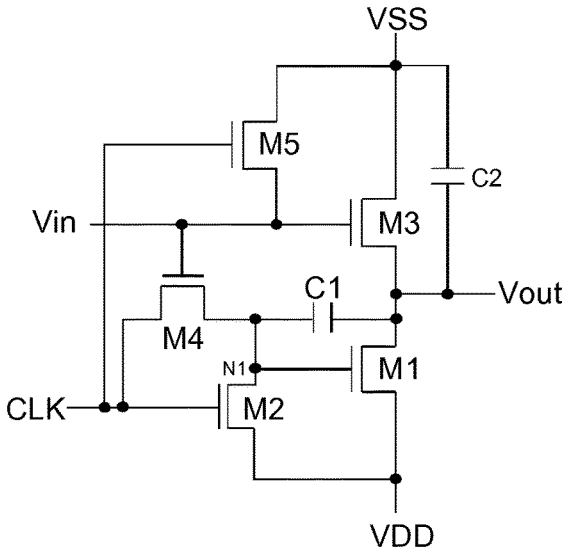

In this embodiment, the inverting circuit may include both the second capacitor C2 and the fifth transistor M5, as shown in FIG. 6*e*. The connection relation between the second capacitor C2 and the fifth transistor M5 is the same as the above connection relation, and the driving manner is also the same as above, as shown in FIG. 6*b*.

The structure and driving method for the inverting circuit according to the embodiment of the invention have been described in detail hereinbefore. The principle and embodiment of the invention are explained in specific examples herein. The descriptions of the embodiments above are only used to help understanding the method and core idea of the invention. Modifications can be made to the embodiment and the application scope of the invention by those skilled in the art based on the idea of the invention. In conclusion, the content of the description should not be interpreted as to limit the invention.

What is claimed:

1. An inverting circuit, applicable to an active matrix organic light emitting display, comprising:

a pull-up unit comprising first and second transistors, comprising:

a first power supply input terminal, wherein the first power supply input terminal is configured to receive a first voltage signal, and first, second, and third terminals, wherein the first terminal is configured to receive a first control signal, and the third terminal is electrically connected to a signal output terminal and is configured to output a first level signal;

a pull-down unit only including third and fourth transistors and no other transistors, comprising:

a second power supply input terminal, and fourth, fifth, and sixth terminals, wherein the fourth terminal is electrically connected to the second terminal of the pull-up unit, the second power supply input terminal is configured to receive a second voltage signal, the fifth terminal is configured to receive a second control signal, and the sixth terminal is electrically connected to the signal output terminal and is configured to output a second level signal; and a first capacitor, wherein a first terminal of the first capacitor is only electrically connected to the second terminal of the pull-up unit and the fourth terminal of the pull-down unit, and a second terminal of the first capacitor is electrically connected to the third terminal of the pull-up unit and the sixth terminal of the pull-down unit, wherein the first terminal of the pull-up unit is a level signal input terminal, and the fifth terminal of the pull-down unit is a clock signal input terminal repeatedly receiving a clock signal in a frame period, the first control signal input into the level signal input terminal of the pull-up unit and the second control signal input into the clock signal input terminal of the pull-down unit are not inverted signals, and the pull-down unit only has one clock signal input terminal, wherein:

the first transistor, the second transistor, the third transistor and the fourth transistor each are P-type transistors, the second terminal of the pull-up unit is a third electrode of the second transistor, the third terminal of the pull-up unit is a first electrode of the first transistor, and the fourth terminal of the pull-down unit is a third electrode of the fourth transistor, and the sixth terminal of the pull-down unit is a third electrode of the third transistor, wherein:

the first electrode of the first transistor is connected to the second terminal of the first capacitor, to the third electrode of the third transistor, and to the signal output terminal;

a second electrode of the first transistor is connected to a second electrode of the second transistor and to the level signal input terminal;

a third electrode of the first transistor is connected to the first power supply input terminal;

the first electrode of the second transistor is connected to a second electrode of the fourth transistor and to the clock signal input terminal;

the third electrode of the second transistor is connected to a second electrode of the third transistor, to the third electrode of the fourth transistor, and to the first terminal of the first capacitor; and a first electrode of the third transistor is connected to a first electrode of the fourth transistor and to the second power supply input terminal.

2. An inverting circuit, applicable to an active matrix organic light emitting display, comprising:

a pull-up unit comprising first and second transistors, comprising:

a first power supply input terminal, wherein the first power supply input terminal is configured to receive a first voltage signal, and first, second, and third terminals, wherein the first terminal is configured to receive a first control signal, and the third terminal is electrically connected to a signal output terminal and is configured to output a first level signal;

a pull-down unit only including third and fourth transistors and no other transistors, comprising:

a second power supply input terminal, and fourth, fifth, and sixth terminals, wherein the fourth terminal is electrically connected to the second terminal of the pull-up unit, the second power supply input terminal is configured to receive a second voltage signal, the fifth terminal is configured to receive a second control signal, and the sixth terminal is electrically connected to the signal output terminal and is configured to output a second level signal; and a first capacitor, wherein a first terminal of the first capacitor is only electrically connected to the second terminal of the pull-up unit and the fourth terminal of the pull-down unit, and a second terminal of the first capacitor is electrically connected to the third terminal of the pull-up unit and the sixth terminal of the pull-down unit, wherein:

the fifth terminal of the pull-down unit is a level signal input terminal, and the first terminal of the pull-up unit is a clock signal input terminal repeatedly receiving a clock signal in a frame period, the first control signal input into the first terminal of the pull-up unit and the second control signal input into the fifth terminal of the pull-down unit are not inverted signals, the pull-up unit only has one clock signal input terminal, the first transistor, the second transistor, the third transistor and the fourth transistor each are N-type transistors, the second terminal of the pull-up unit is a third electrode of the second transistor, the third terminal of the pull-up unit is a third electrode of the first transistor, the fourth terminal of the pull-down unit is a first electrode of the fourth transistor, and the sixth terminal of the pull-down unit is a first electrode of the third transistor.

3. The inverting circuit according to claim 2, wherein a first electrode of the first transistor is connected to a first electrode of the second transistor and to the first power supply input terminal;

a second electrode of the first transistor is connected to the third electrode of the second transistor, to the first electrode of the fourth transistor, and to the first terminal of the first capacitor;

the third electrode of the first transistor is connected to the first electrode of the third transistor, to the second terminal of the first capacitor, and to the signal output terminal;

a second electrode of the second transistor is connected to the clock signal input terminal;

a second electrode of the third transistor is connected to a second electrode of the fourth transistor, and to the level signal input terminal; and a third electrode of the third transistor is connected to the second power supply input terminal.

4. The inverting circuit according to claim 2, wherein a first electrode of the first transistor is connected to a first electrode of the second transistor and to the first power supply input terminal;

a second electrode of the first transistor is connected to the third electrode of the second transistor, to the first electrode of the fourth transistor, and to the first terminal of the first capacitor;

the third electrode of the first transistor is connected to the first electrode of the third transistor, to the second terminal of the first capacitor, and to the signal output terminal;

a second electrode of the second transistor is connected to the clock signal input terminal;

a second electrode of the third transistor is connected to a second electrode of the fourth transistor and to the level signal input terminal;

a third electrode of the third transistor is connected to the second power supply input terminal; and the third electrode of the fourth transistor is connected to the second electrode of the second transistor and to the clock signal input terminal.

5. The inverting circuit according to claim 3, further comprising a second capacitor, wherein:

a first terminal of the second capacitor is connected to the third electrode of the third transistor, and to the second power supply input terminal; and a second terminal of the second capacitor is connected to the signal output terminal.

6. The inverting circuit according to claim 3, further comprising a fifth transistor, wherein:

a first electrode of the fifth transistor is connected to the second electrode of the third transistor, to the second electrode of the fourth transistor, and to the level signal input terminal;

a second electrode of the fifth transistor is connected to the second electrode of the second transistor and to the clock signal input terminal;

a third electrode of the fifth transistor is connected to the third electrode of the third transistor, and to the second power supply input terminal.

7. The inverting circuit according to claim 6, further comprising a second capacitor, wherein a first terminal of the second capacitor is connected to the third electrode of the third transistor, to the third electrode of the fifth transistor, and to the second power supply input terminal; and a second terminal of the second capacitor is connected to the signal output terminal.

8. A driving method for an inverting circuit, wherein the inverting circuit comprises:

a pull-up unit including a first transistor and a second transistor, comprising:

a first power supply input terminal, wherein the first power supply input terminal is configured to receive a first voltage signal, and first, second, and third terminals, wherein the first terminal is configured to receive a first control signal, and the third terminal is electrically connected to a signal output terminal and is configured to output a first level signal;

a pull-down unit including a third transistor and a fourth transistor, comprising:

a second power supply input terminal, and fourth, fifth, and sixth terminals, wherein the fourth terminal is electrically connected to the second terminal of the pull-up unit, the second power supply input terminal is configured to receive a second voltage signal, the fifth terminal is configured to receive a second control signal, and the sixth terminal is electrically connected to the signal output terminal and is configured to output a second level signal; and a first capacitor, wherein a first terminal of the first capacitor is electrically connected to the second terminal of the pull-up unit and the fourth terminal of the pull-down unit, and a second terminal of the capacitor is electrically connected to the third terminal of the pull-up unit and the sixth terminal of the pull-down unit, wherein:

the first transistor, the second transistor, the third transistor and the fourth transistor each are P-type transistors, the first terminal of the pull-up unit is a level signal input terminal, the second terminal of the pull-up unit is a first electrode of the second transistor, the third terminal of the pull-up unit is a first electrode of the first transistor, the fourth terminal of the pull-down unit is a third electrode of the fourth transistor, the fifth terminal of the pull-down unit is a clock signal input terminal, and the sixth terminal of the pull-down unit is a third electrode of the third transistor, wherein the driving method comprises:

during a first stage T1:

a high-level signal is input into the level signal input terminal, a low-level signal is input into the clock signal input terminal, the pull-down unit is turned on and the pull-up unit is turned off by turning off the first transistor and the second transistor and turning on the third transistor and the fourth transistor, a low-level signal from the second voltage signal is transmitted to the second electrode of the first transistor and to the signal output terminal, the first transistor is turned off, and a low-level signal is output from the signal output terminal;

during a second stage T2:

a low-level signal is input into the level signal input terminal, a high-level signal is input into the clock signal input terminal, the pull-down unit is turned off and the pull-up unit is turned on by turning on the first transistor and the second transistor and turning off the third transistor and the fourth transistor, a high-level signal input into the first power supply input terminal is transmitted to the second electrode of the first transistor via the second transistor, the first transistor is turned on, the second transistor maintains an on-state until a level of the second electrode of the first transistor becomes VDD-Vth, an output signal from the signal output terminal is changed into a high-level signal from a low-level signal as a result of the first electrode of the first transistor being connected to the first power supply input terminal, a level of the first terminal of the first capacitor, and a level of the second electrode of the first transistor are further pulled up due to a coupling of the first capacitor, the first transistor is turned on, the high-level signal input into the first power supply input terminal is transmitted to the signal output terminal integrally;

during a third stage T3:

the second transistor, the third transistor, and the fourth transistor each are turned off, the high level of the second electrode of the first transistor during the second stage T2 is maintained due to the first capacitor, the first transistor remains in an on-state, and the signal output terminal keeps outputting a high-level signal; and during a fourth stage T4:

when a high-level signal is input into the clock signal input terminal, an electrode of the second transistor connected to the second electrode of the first transistor becomes a source electrode due to the high level of the second electrode of the first transistor, the second transistor is in an off-state, the second electrode of the first transistor remains at high level due to the first capacitor, the first transistor remains in the on-state, and the first transistor continues transmitting the high-level signal to the signal output terminal.

* * * * *